US006098504A

United States Patent [19]

Hu

[11] Patent Number: 6,098,504

[45] Date of Patent: Aug. 8, 2000

[54] NUT HOLDING DEVICES

[76] Inventor: Bobby Hu, 8F, No. 536-1, Ta Chin Street, Taichung, Taiwan

[21] Appl. No.: 09/293,034

[22] Filed: Apr. 16, 1999

[51] Int. Cl.[7] ..... B25B 13/02

[52] U.S. Cl. ..... 81/125

[58] Field of Search ..... 81/125

[56] References Cited

U.S. PATENT DOCUMENTS

| | | | |
|---|---|---|---|
| 3,069,946 | 12/1962 | Zilliox | 81/125 |
| 3,745,861 | 7/1973 | Totsu et al. | 81/125 |
| 3,834,253 | 9/1974 | Carr | 81/125 |
| 3,835,737 | 9/1974 | Carr | 81/125 |

*Primary Examiner*—James G. Smith
*Assistant Examiner*—David B. Thomas
*Attorney, Agent, or Firm*—Alan Kamrath; Oppenheimer Wolff & Donnelly LLP

[57] ABSTRACT

A nut holding device is mounted in a ratcheting tool of the type including a compartment defined by a polygonal inner periphery. The nut holding device includes a body mounted in the compartment, a number of elastic plates formed on an upper side of the body for holding a nut to be loosened, and a number of positioning members formed on the body to position the body in the compartment. A number of posts are formed on an underside of the body for supporting the body in the compartment of the ratcheting tool in an elevated manner such that the nut held between the elastic plates is adjacent to an open top face of the compartment of the ratcheting tool.

18 Claims, 13 Drawing Sheets

NUT HOLDING DEVICES

BACKGROUND OF THE INVENTION

1. Field of the Invention

The present invention relates to nut holding devices that are mounted to a ratcheting tool for holding a nut after loosening.

2. Description of the Related Art

A conventional socket of, e.g., a ratchet wrench cannot hold a nut received therein. More specifically, the nut will be left on the site after it has been loosened. Manual removal of the nut is required and inadvertent loss of the nut often occurs. This problem is aggravated when the nut is disposed in a deep hole.

FIGS. 20 and 21 of the drawings illustrate a conventional nut holding member 24' received in a socket 20'. The inner periphery of the socket 20' includes two longitudinal grooves 221' and an annular groove 222' adjacent to an open end of the socket 20'. The nut holding member 24' is substantially U-shaped having two limbs 241' received in the longitudinal grooves 221', respectively. One of the limbs 241' includes two arcuate portions 242' for retaining a nut 25' (FIG. 22). A distal end of the nut holding member 24' includes a retainer element 244' received in the annular groove 222' for retaining the nut 25' in the socket 20'. Nevertheless, the holding effect of the nut holding member 24' is found unsatisfactory since the nut 25' is held at only two sides thereof by two limbs 241' (FIG. 22). Thus, the nut 25' still tends to fall from the socket 20'. In addition, the U-shaped configuration of the nut holding member 24' is apt to deform as a result of expansion and thus might be disengaged from the longitudinal grooves 221'. As a result, positioning of the nut holding member 24' only relies upon the retainer element 244' in the annular groove 222' and thus is unreliable. This adversely affects the holding effect. Furthermore, it is difficult to machine the longitudinal grooves 221 ' and the annular groove 222' in the inner periphery of the socket 20', especially for those sockets 20' having an inner diameter smaller than 10 mm. A further drawback is that the nut holding member 24' cannot be applied to the currently available sockets without provision of the grooves 221' and 222'. Therefore, a set of sockets containing all sizes must be manufactured so as to form the grooves 221' and 222'. This results in an additional cost to the manufacturers and the users.

The present invention is intended to provide nut holding devices that mitigate and/or obviate the above problems.

SUMMARY OF THE INVENTION

In accordance with a first aspect of the invention, a nut holding device is provided to be mounted in a ratcheting tool of the type including a compartment defined by a polygonal inner periphery, the nut holding device comprising:

- a body adapted to be mounted in the compartment, the body including an upper side;
- a holding means formed on the upper side of the body for holding a nut to be loosened; and
- a positioning means formed on the body to position the body in the compartment.

The body includes an outer periphery, and the holding means includes a plurality of annularly spaced elastic plates extended upward and inward from the outer periphery of the body. Each elastic plate includes a distal upper end that extends outward for guiding the nut into a holding space defined by the elastic plates. The number of the elastic plates is at least three.

The positioning means includes a plurality of positioning members extended outward and upward from the outer periphery of the body. Each positioning member abuts against the polygonal inner periphery of the ratcheting tool when the nut holding device is received in the compartment of the ratcheting tool.

The body further comprises a supporting means formed on an underside thereof for supporting the body in the compartment of the ratcheting tool in an elevated manner. The supporting means includes a plurality of posts provided along a periphery of the underside of the body. The nut held in the holding means is adjacent to an open top face of the compartment of the ratcheting tool.

In accordance with a second aspect of the invention, a nut holding device is provided to be mounted in a ratcheting tool of the type including a compartment defined by a polygonal inner periphery, the nut holding device comprising:

- a body adapted to be mounted in the compartment, the body including an outer periphery;
- a plurality of annularly spaced elastic plates extended upward from the outer periphery of the body for holding a nut to be loosened; and
- a plurality of guide members each located between two adjacent said elastic plates and extended upward from the outer periphery of the body to a level above the elastic plates for guiding the nut to be loosened into a holding space defined by the elastic plates.

A positioning means is formed on the body to position the body in the compartment. The positioning means includes a plurality of positioning members extended outward and upward from the outer periphery of the body. Each positioning member abuts against the polygonal inner periphery of the ratcheting tool when the nut holding device is received in the compartment of the ratcheting tool.

The body further comprises a supporting means formed on an underside thereof for supporting the body in the compartment of the ratcheting tool in an elevated manner. The supporting means includes a plurality of posts provided along a periphery of the underside of the body. The nut held between the elastic plates is adjacent to an open top face of the compartment of the ratcheting tool. The number of the elastic plates is at least three.

In accordance with a third aspect of the invention, a nut holding device is provided to be mounted in a ratcheting tool of the type including a compartment defined by a polygonal inner periphery, the nut holding device comprising:

- a body adapted to be mounted in the compartment, the body including an outer periphery and an underside;
- a plurality of annularly spaced elastic plates extended upward from the outer periphery of the body for holding a nut to be loosened; and
- a plurality of positioning members extended downward from the underside of the body, each said positioning member including a protruded section that is in frictional contact with the polygonal inner periphery of the ratcheting tool to prevent disengagement of the body from the ratcheting tool.

The nut held between the elastic plates is adjacent to an open top face of the compartment of the ratcheting tool. The number of the elastic plates is at least three. A guide member is located between two adjacent elastic plates and extended upward from the outer periphery of the body to a level above the elastic plates for guiding the nut to be loosened into a holding space defined by the elastic plates.

The nut holding devices of the present invention can be directly mounted into conventional sockets without any processing on the sockets, which is extremely convenient and inexpensive to the users. It is not necessary for the manufacturers to prepare additional molds to produce modified sockets, and the stock of the modified sockets is accordingly not required. In addition, the nut is reliably held at three faces thereof. The guide members provide a convenient and rapid way to guide the nut into the socket. The nut after loosening can be easily removed from the socket.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
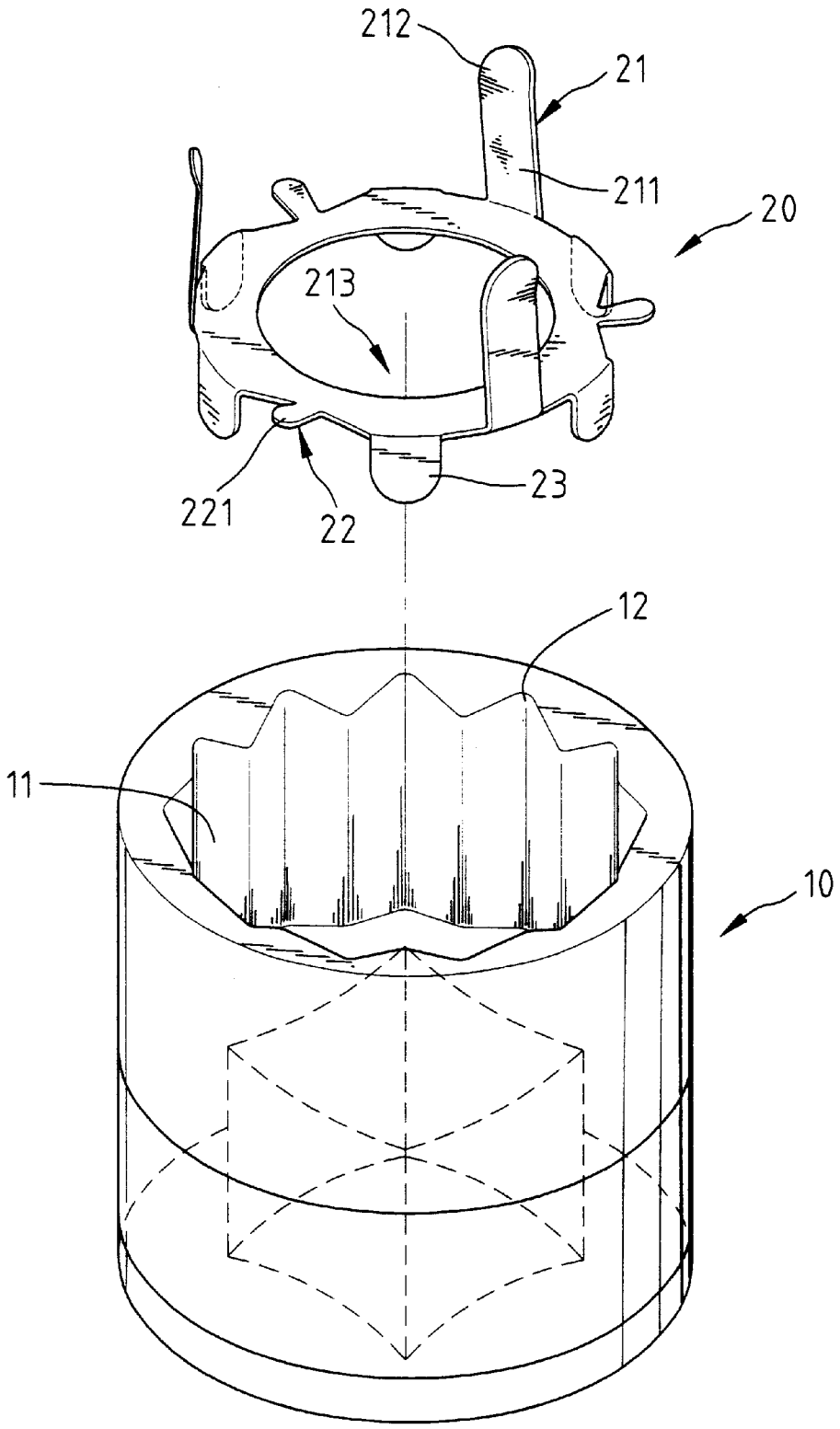
FIG. 1 is an exploded perspective view of a socket and a first embodiment of a nut holding device in accordance with the present invention.
Figure 2:
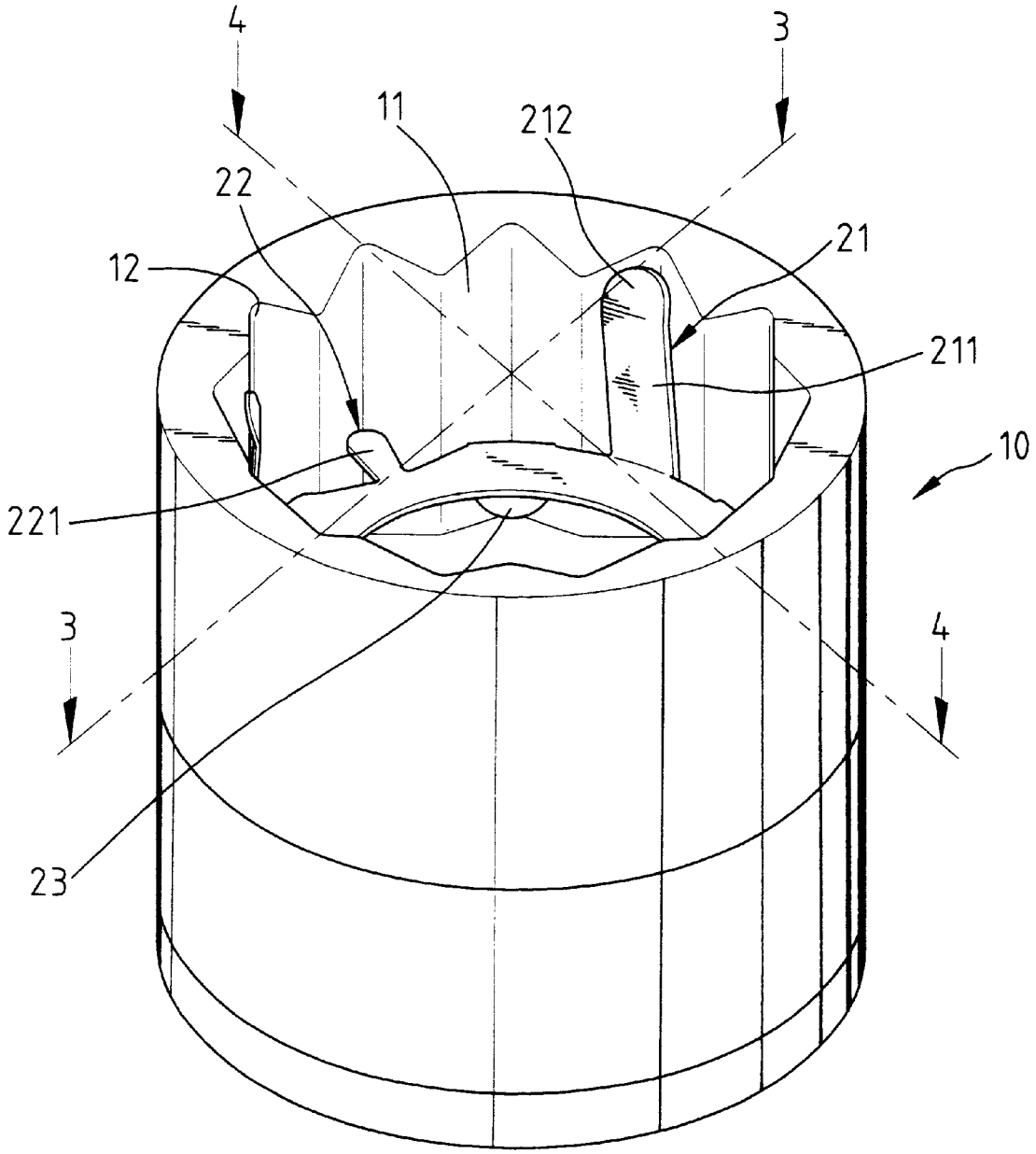
FIG. 2 is a perspective view of the socket with the first embodiment of the nut holding device received therein.

Referring to the drawings and initially to FIGS. 1 and 2, a first embodiment of a nut holding device in accordance with the present invention is designated by "20" and adapted to be received in a ratcheting tool 10 (e.g., a socket) of the type having a compartment 11 defined by a polygonal inner periphery 12. In this embodiment, the polygonal inner periphery 12 consists of twelve faces. The socket 10 is an ordinary socket without any modification.

Figure 4:
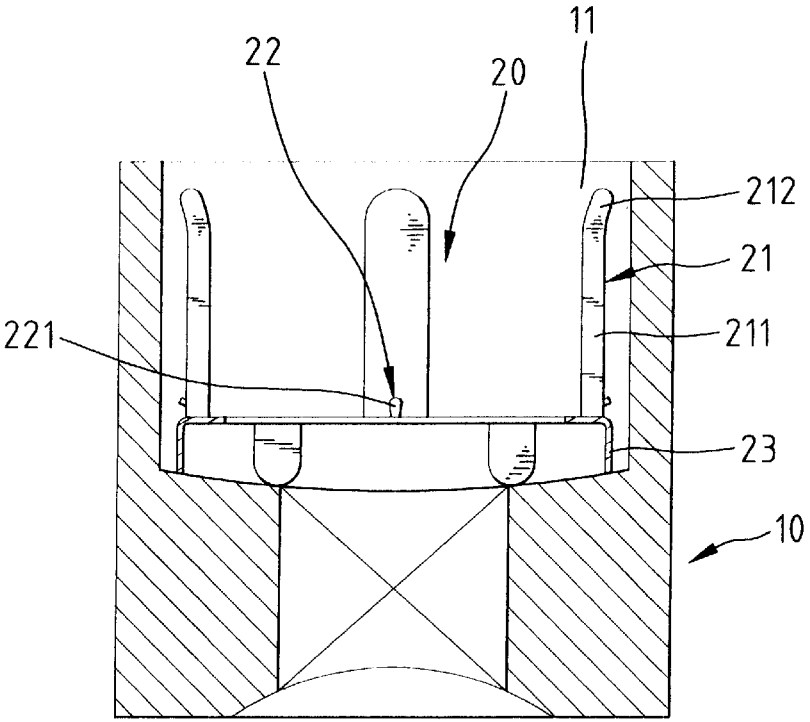
FIG. 4 is a sectional view taken along line 4—4 in FIG. 2.
Figure 3:
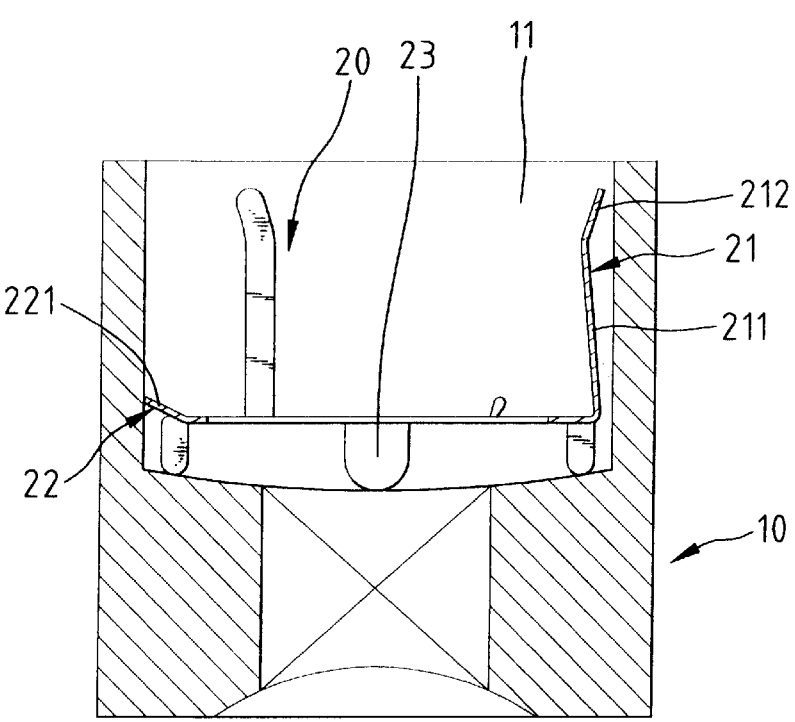
FIG. 3 is a sectional view taken along line 3—3 in FIG. 2.
Figure 8:
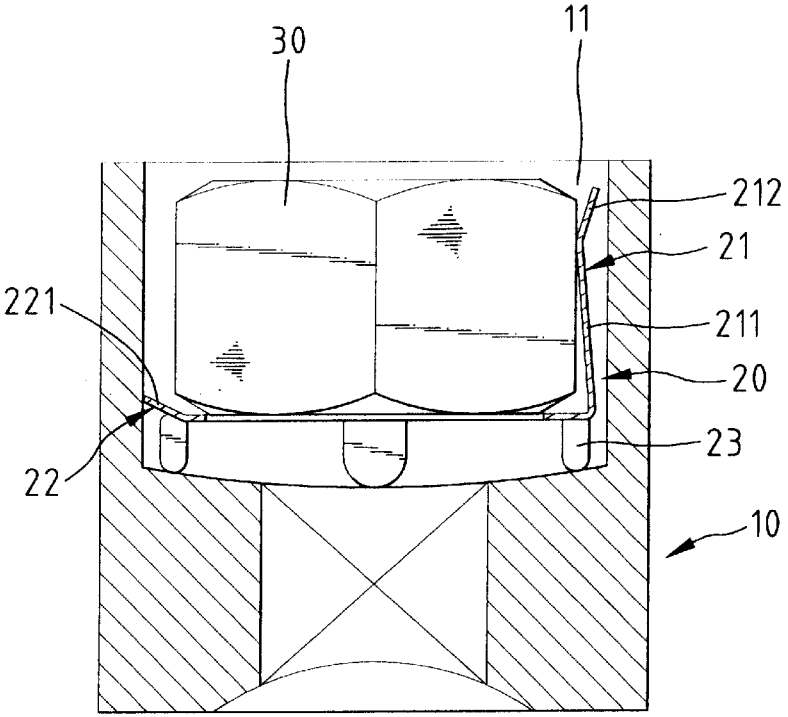
FIG. 8 is a cross sectional view of the socket in FIG. 6.

The nut holding device 20 includes a substantially ring-like body with a holding means 21 for holding a nut 30 (FIG. 8). In this embodiment, the holding means 21 includes three annularly spaced elastic plates 211 extended upwardly from the ring-like body. Each elastic plate 211 inclines inwardly and includes a distal upper end 212 that extends outwardly. The upper ends 212 of the elastic plates 211 guide the nut 30 into a holding space 213 defined by the holding means 21. A positioning means 22 is provided to an outer periphery of the ring-like body. The positioning means 22 includes three annularly spaced hooks 221 each arranged between two adjacent elastic plates 211. In addition, each hook 221 slightly extends upward and outward to bear against the inner periphery 12 of the socket 10 when the nut holding device 20 is mounted into the compartment 11 of the socket 10. The hook 221 is so arranged to prevent disengagement of the nut holding device 20 from the socket 10. In addition, a plurality of posts 23 are provided to an underside of the ring-like body for supporting the nut holding device 20 in the compartment 11 of the socket 10 in an elevated manner (FIGS. 3 and 4). Thus, the nut 30 held in the holding space 213 is substantially flush with a top face of the socket 10 to thereby allow easy removal of the nut 30 from the nut holding device 20 (FIG. 8).

Figure 6:
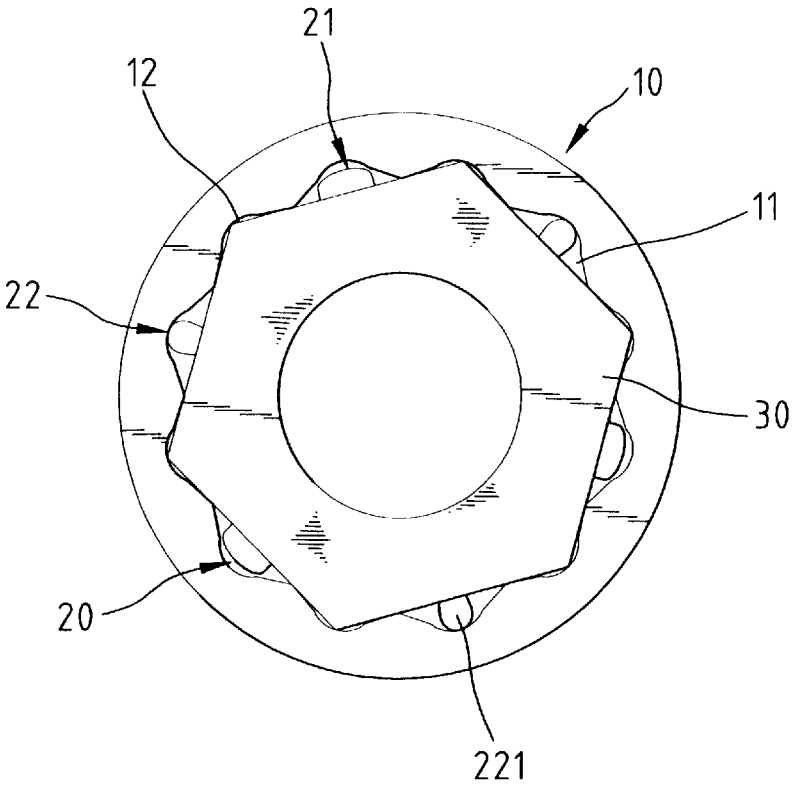
FIG. 6 is a top view similar to FIG. 5, wherein a nut is received in the socket.
Figure 5:
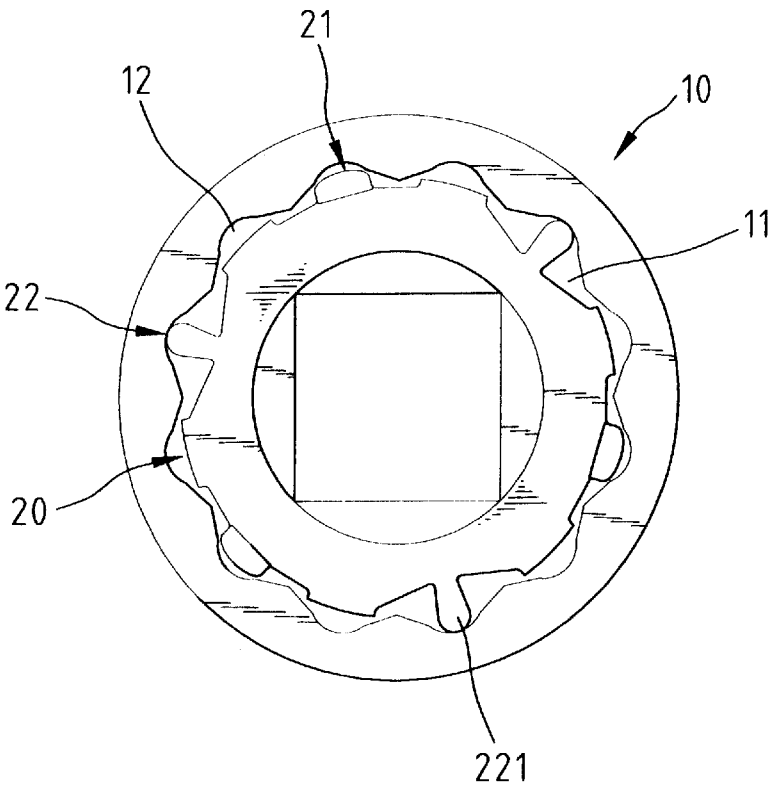
FIG. 5 is a top view of the socket in FIG. 2.
Figure 7:
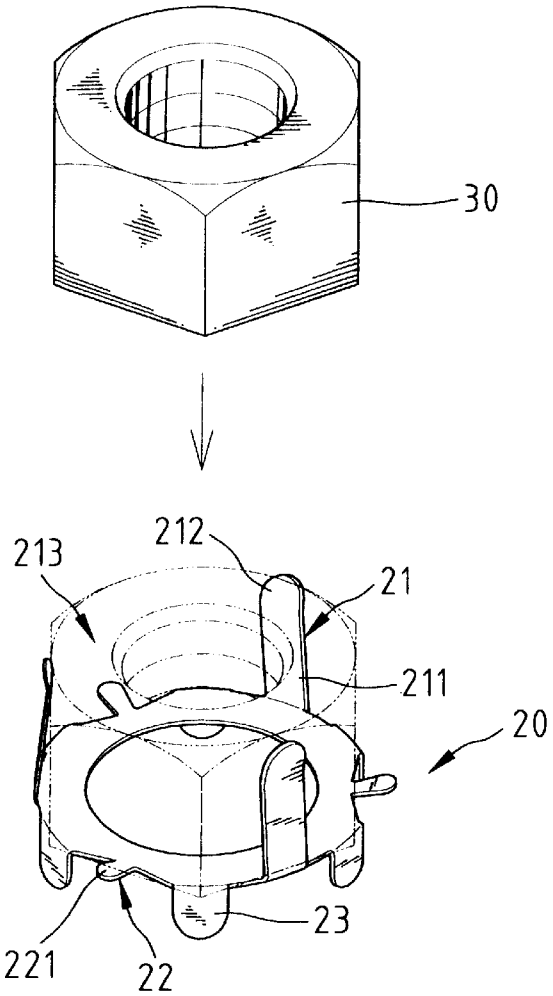
FIG. 7 is an exploded perspective view illustrating engagement of a nut and the first embodiment of the nut holding device in accordance with the present invention.
Figure 9:
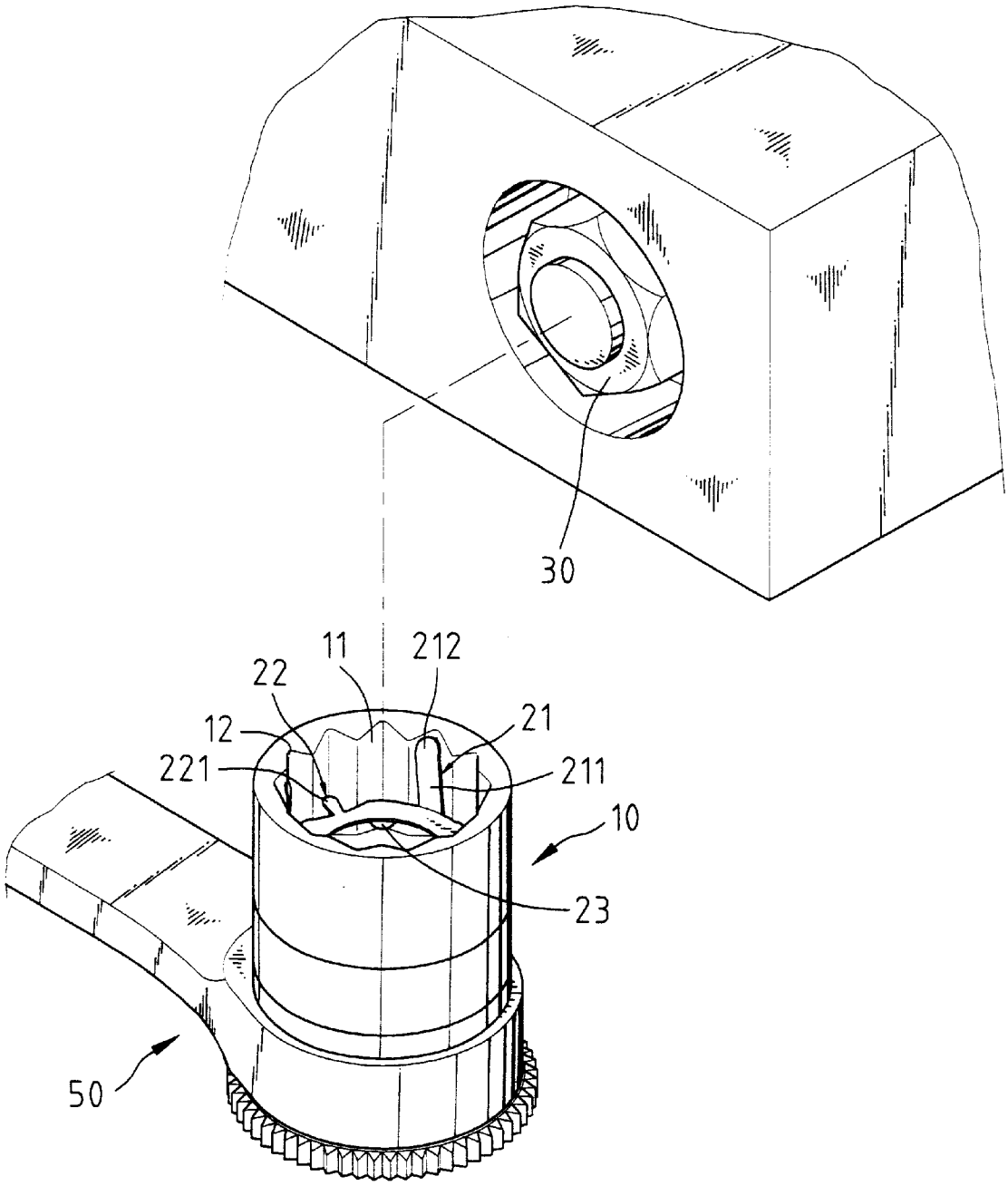
FIG. 9 is a perspective view illustrating application of the nut holding device to a ratchet wrench.

Referring to FIG. 3, when the nut holding device 20 is mounted in the compartment 11 of the socket 10, each hook 221 has a distal end abutting against the inner periphery 12 to prevent removal of the nut holding device 20 from the socket 10. Referring to FIG. 5, each hook 221 is fittingly received in an apex area of the inner periphery 12 to securely retain the nut holding device 20 in the socket 10. Referring to FIGS. 6 and 8, when a nut 30 is received in the socket 10, three faces of the nut 30 are held by the elastic plates 211 of the holding means 21 to reliably retain the nut 30 in the socket 10. FIG. 7 illustrates engagement between the nut 30 and the nut holding device 20. The nut 30 to be loosened is guided into the holding space 213 by the distal upper ends 212 of the elastic plates 211. The nut 30 can be loosened by a conventional manner and FIG. 9 illustrates a typical application of the socket 10 to a ratchet wrench 50 for loosening the nut 30. After loosening, the nut 30 received in the socket 10 can be easily removed by means of shaking the socket 10 such that the nut 30 disengages from the elastic plates 211 and falls under the action of gravity.

Figure 10:
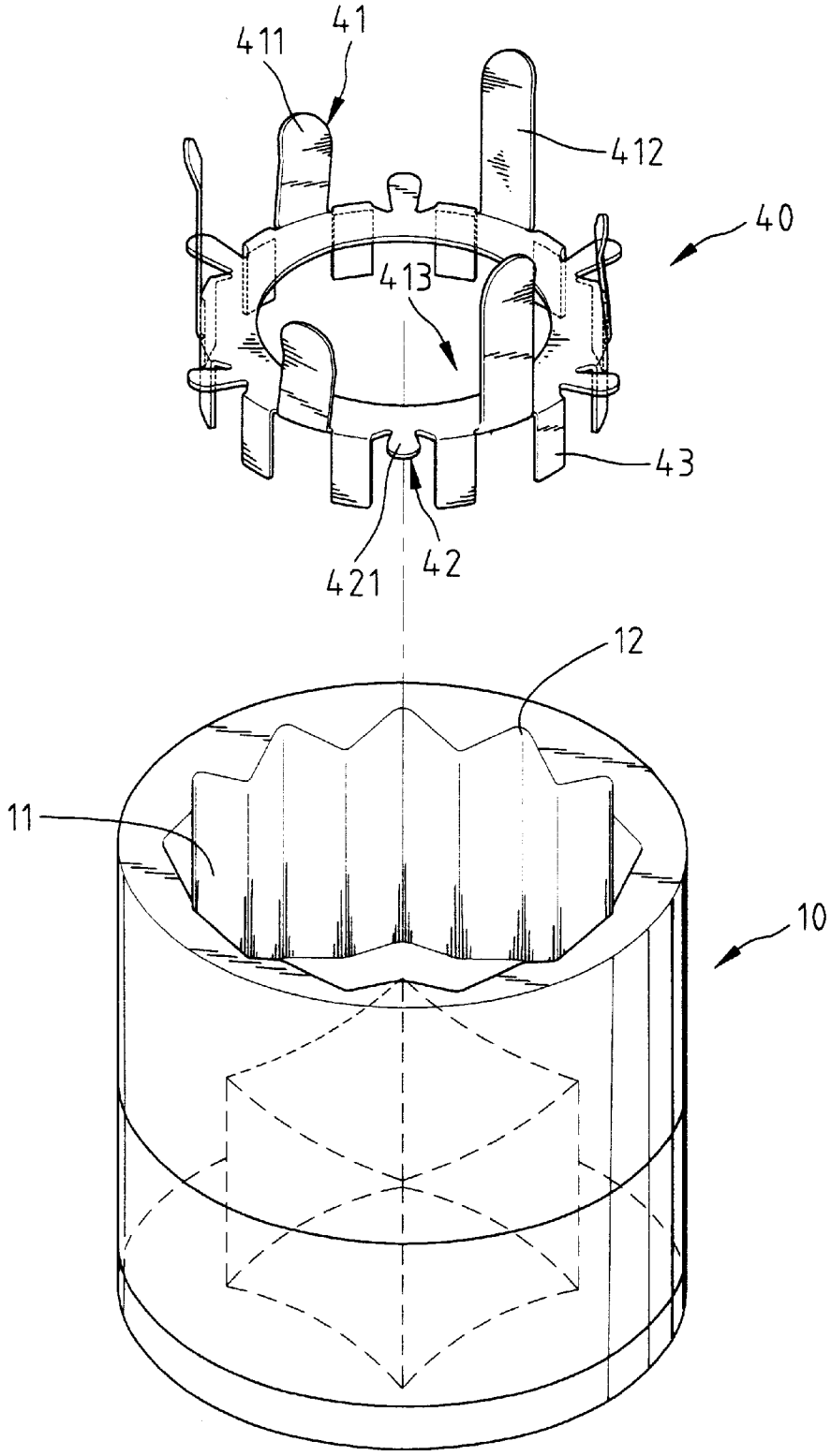
FIG. 10 is an exploded perspective view of a socket and a second embodiment of the nut holding device in accordance with the present invention.
Figure 11:
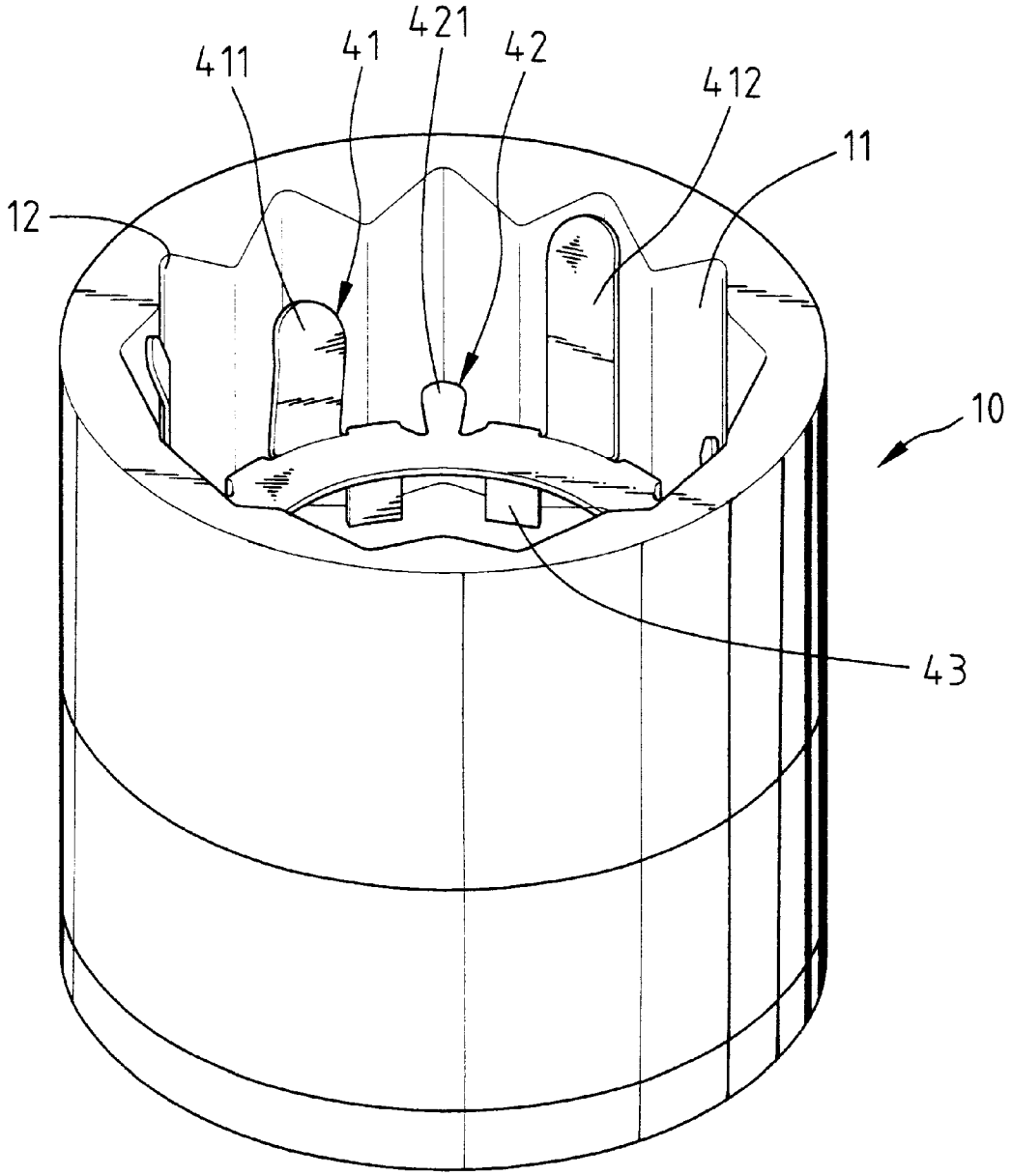
FIG. 11 is an exploded perspective view of the socket with the second embodiment of the nut holding device received therein.
Figure 13:
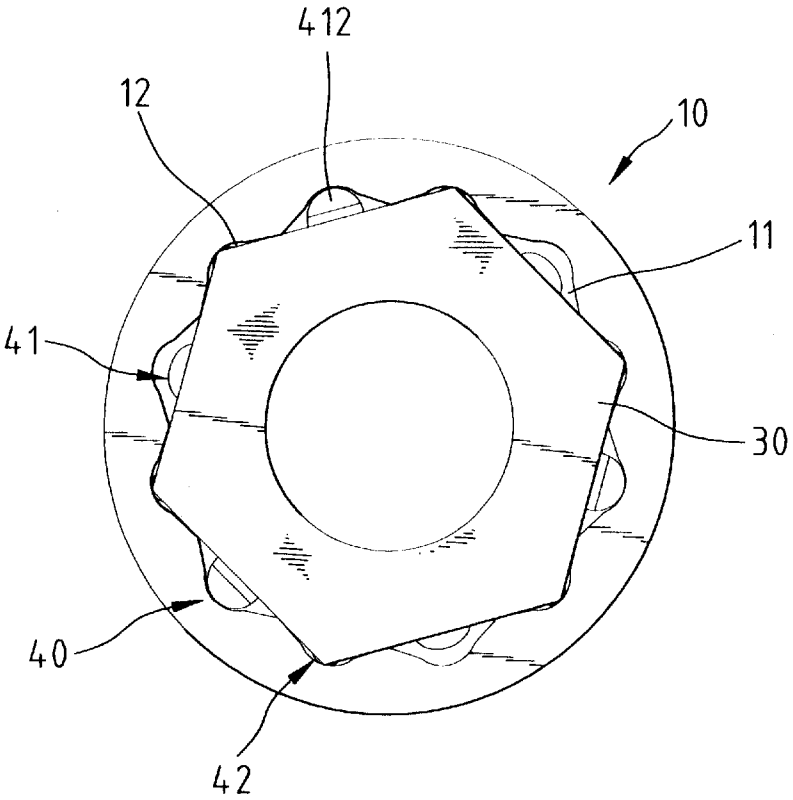
FIG. 13 is a top view similar to FIG. 12, wherein a nut is received in the socket.

Referring to FIGS. 10 and 11, a second embodiment of a nut holding device in accordance with the present invention includes a substantially ring-like body with a holding means 41 for holding a nut 30 (FIG. 13). In this embodiment, the holding means 41 includes three annularly spaced elastic plates 411 extended upwardly and inwardly from the ring-like body. Arranged between each two adjacent elastic plates 411 is an outwardly extending guide member 412 that extends to a level above the elastic plate 411 for guiding the nut 30 into a holding space 413 defined by the elastic plates 411. The nut 30 can be inserted into the holding space 413 only when the former is guided in an appropriate angle. This allows the user to rapidly insert the nut 30 into the socket 10 without repeated try-in-error.

Figure 15:
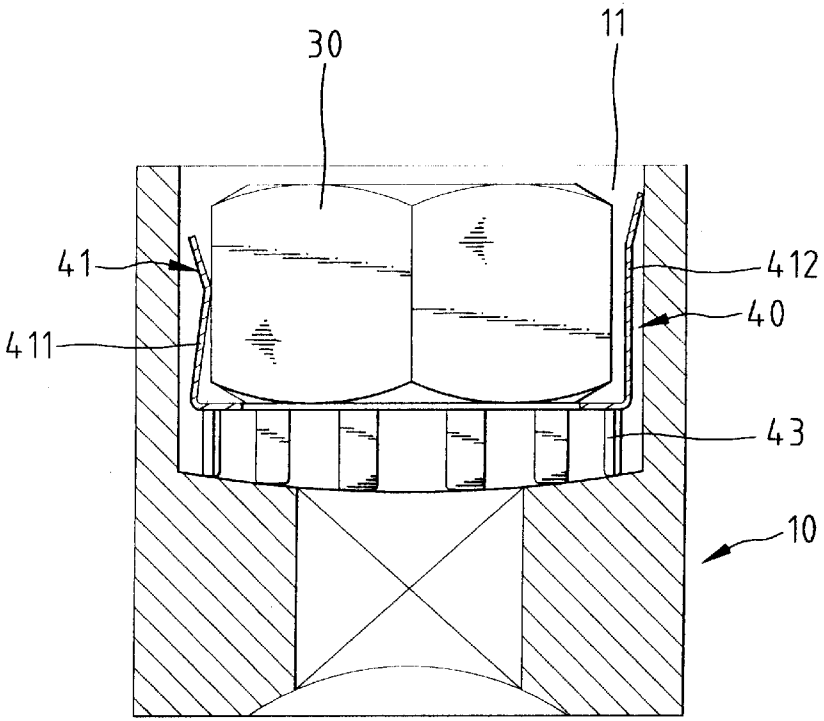
FIG. 15 is a cross sectional view of the socket in FIG. 13.

A positioning means 42 is provided to an outer periphery of the ring-like body. The positioning means 42 includes a plurality of annularly spaced hooks 421 each arranged between an elastic plate 411 and an adjacent guide member 412. In addition, each hook 421 slightly extends upward and outward such that the hook 421 bears against the inner periphery 12 of the socket 10 when the nut holding device 40 is mounted into the compartment 11 of the socket 10. The hook 421 is so arranged to prevent disengagement of the nut holding device 40 from the socket 10. In addition, a plurality of posts 43 are provided to an underside of the ring-like body for supporting the nut holding device 40 in the compartment 11 of the socket 10 in an elevated manner (FIG. 15). Thus, the nut 30 held in the holding space 413 is substantially flush with a top face of the socket 10 to thereby allow easy removal of the nut 30 from the nut holding device 40.

Figure 12:
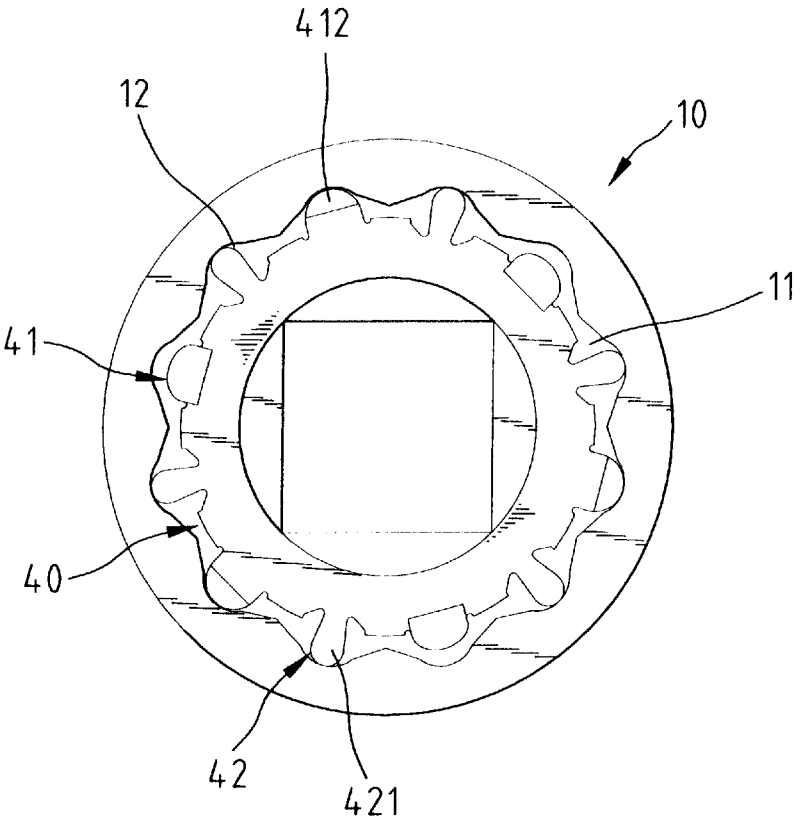
FIG. 12 is a top view of the socket in FIG. 11 after assembly.
Figure 14:
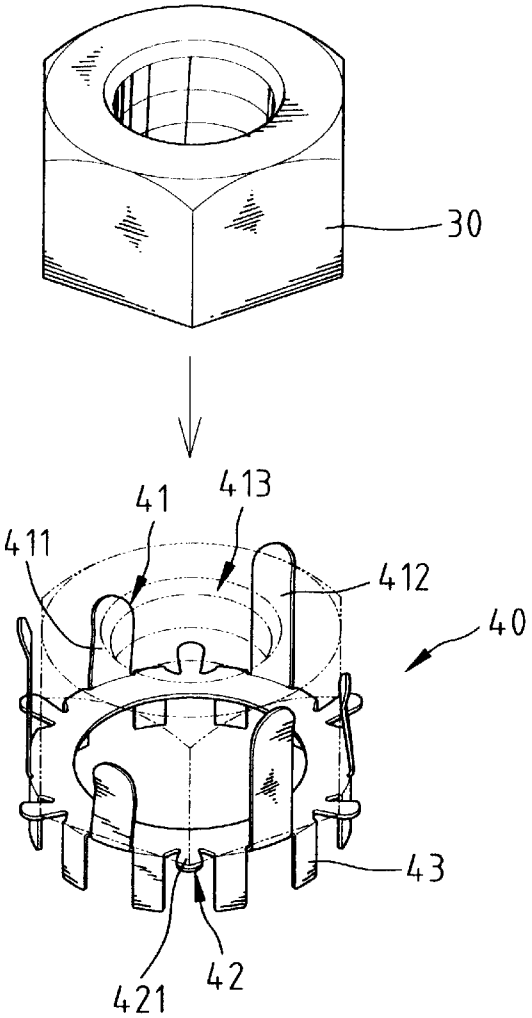
FIG. 14 is an exploded perspective view illustrating engagement of a nut and of the second embodiment of the nut holding device in accordance with the present invention.

Referring to FIG. 12, when the nut holding device 40 is mounted in the compartment 11 of the socket 10, each hook 421 has a distal end abutting against the inner periphery 12 to prevent removal of the nut holding device 40 from the socket 10. In addition, each hook 421 is fittingly received in an apex area of the inner periphery 12 to securely retain the nut holding device 40 in the socket 10. Referring to FIGS. 13 and 15, when a nut 30 is received in the socket 10, three faces of the nut 30 are held by the elastic plates 411 of the holding means 41 to reliably retain the nut 30 in the socket 10. FIG. 14 illustrates engagement between the nut 30 and the nut holding device 40. The guide members 412 guide the nut 30 to be loosened into the holding space 413. The nut 30 can be loosened by a conventional manner, and after loosening, the nut 30 received in the socket 10 can be easily removed by means of shaking the socket 10 such that the nut 30 disengages from the elastic plates 411 and fall under the action of gravity.

Figure 16:
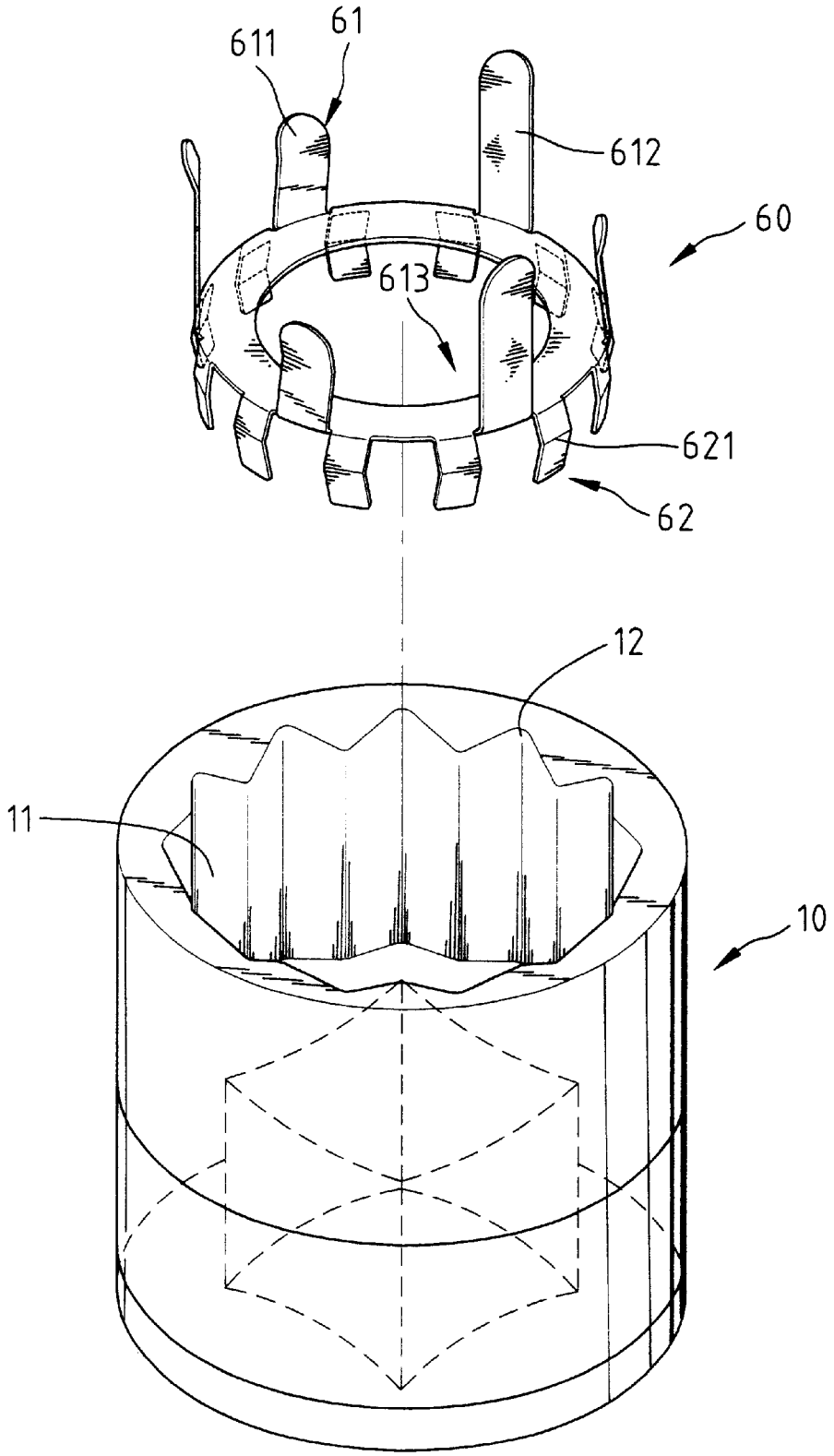
FIG. 16 is an exploded perspective view of the socket with the third embodiment of the nut holding device received therein.
Figure 19:
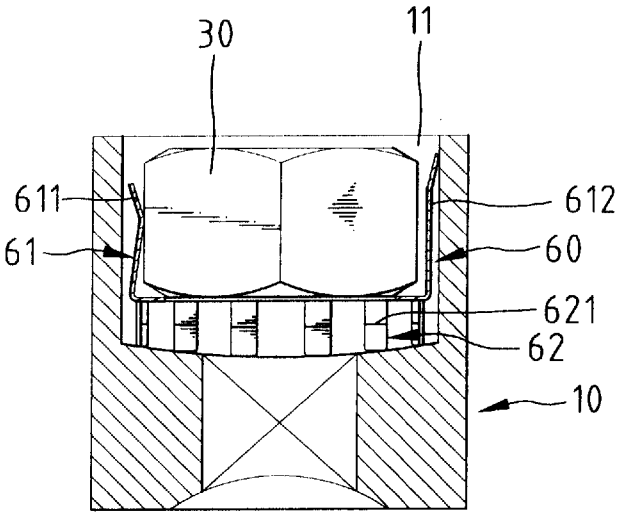
FIG. 19 is a cross sectional view of the socket in FIG. 18.
Figure 18:
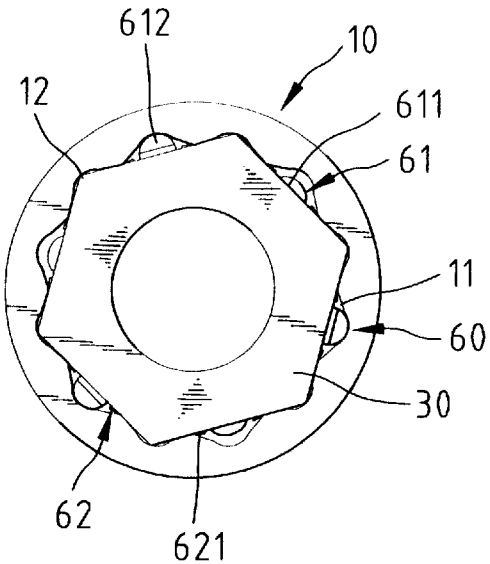
FIG. 18 is a top view similar to FIG. 17, wherein a nut is received in the socket.

Referring to FIG. 16, a third embodiment of a nut holding device in accordance with the present invention includes a substantially ring-like body with a holding means 61 for holding a nut 30 (FIGS. 18 and 19). In this embodiment, the holding means 61 includes three annularly spaced elastic plates 611 extended upwardly from the ring-like body. Arranged between each two adjacent elastic plates 611 is an outwardly extending guide member 612 that is longer than the elastic plate 611 for guiding the nut 30 into a holding space 613 defined by the elastic plates 611. The nut 30 can be inserted into the holding space 613 only when the former is guided in an appropriate angle. This allows the user to rapidly insert the nut 30 into the socket 10 without repeated try-in-error.

A positioning means 62 includes a plurality of annularly spaced positioning members 621 extended downward from the ring-like body. Each positioning means 62 includes a protruded section 621 that is in frictional contact with the inner periphery 12 to prevent disengagement of the nut holding device 60 from the socket 10. In addition, the positioning means 62 support the nut holding device 60 in the compartment 11 of the socket 10 in an elevated manner (FIG. 19). Thus, the nut 30 held in the holding space 613 is substantially flush with a top face of the socket 10 to thereby allow easy removal of the nut 30 from the nut holding device 60.

Figure 17:
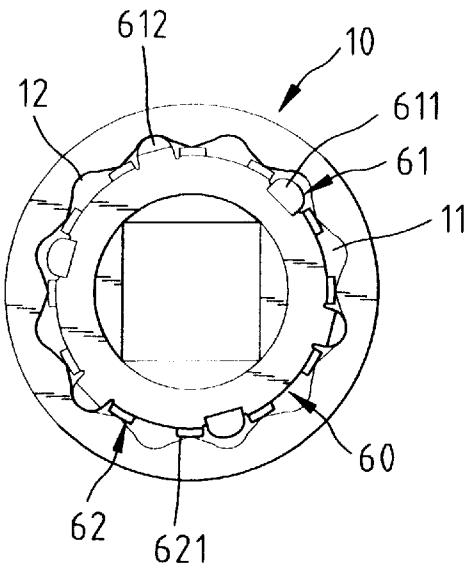
FIG. 17 is a top view of the socket in FIG. 16 after assembly.
Figure 20:
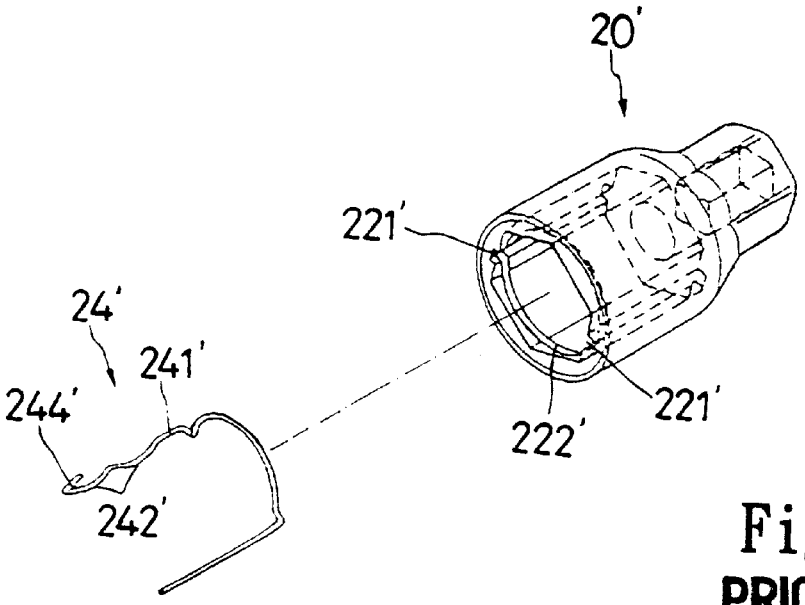
Fig. 20 PRIOR ART
FIG. 20 is an exploded perspective view of a socket and a conventional nut holding device.
Figure 21:
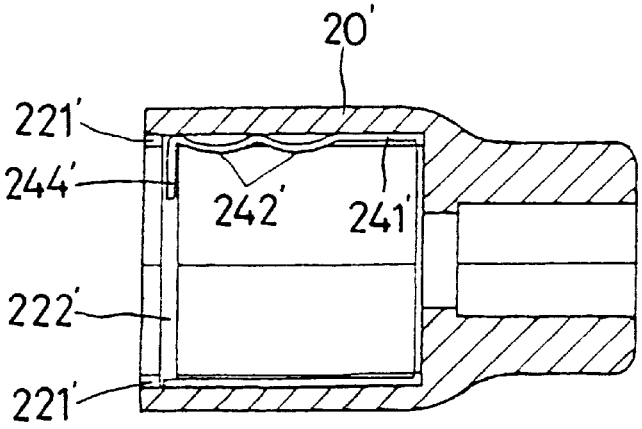
Fig. 21 PRIOR ART
FIG. 21 is a sectional view of the socket with the conventional nut holding device therein.
Figure 22:
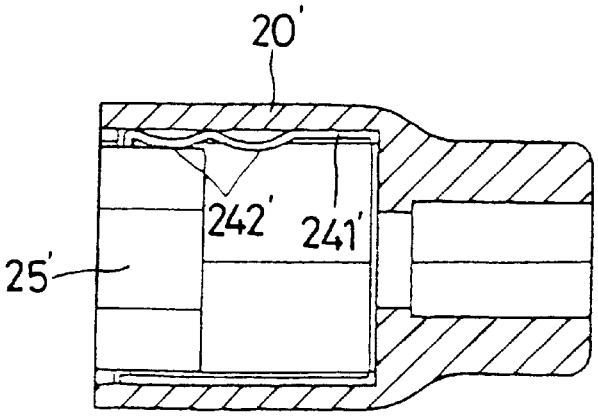
Fig. 22 PRIOR ART
FIG. 22 is a view similar to FIG. 21, wherein a nut is received in the socket.

Referring to FIG. 17, when the nut holding device 60 is mounted in the compartment 11 of the socket 10, the protruded section 621 of each positioning means 62 frictionally abuts against the inner periphery 12 to prevent removal of the nut holding device 60 from the socket 10. Referring to FIGS. 18 and 19, when a nut 30 is received in the socket 10, three faces of the nut 30 are held by the elastic plates 611 of the holding means 61 to reliably retain the nut 30 in the socket 10. The guide members 612 guide the nut 30 to be loosened into the holding space 613. The nut 30 can be loosened by a conventional manner, and after loosening, the nut 30 received in the socket 10 can be easily removed by means of shaking the socket 10 such that the nut 30 disengages from the elastic plates 611 and fall under the action of gravity.

According to the above description, it is appreciated that the nut holding devices of the present invention can be directly mounted into conventional sockets without any processing on the sockets, which is extremely convenient and inexpensive to the users. It is not necessary for the manufacturers to prepare additional molds to produce modified sockets, and the stock of the modified sockets is accordingly not required. In addition, the nut is reliably held at three faces thereof. The guide members provide a convenient and rapid way to guide the nut into the socket. The nut after loosening can be easily removed from the socket.

Although the invention has been explained in relation to its preferred embodiment, it is to be understood that many other possible modifications and variations can be made without departing from the spirit and scope of the invention as hereinafter claimed.

What is claimed is:

1. A nut holding device adapted to be mounted in a ratcheting tool of the type including a compartment defined by a polygonal inner periphery, the nut holding device comprising, in combination:

a body adapted to be mounted in the compartment, wherein the body includes an outer periphery and an upper side;

a holding means formed on the upper side of the body for holding a nut to be loosened, wherein the holding means includes a plurality of annularly spaced elastic plates extended upward and inward from the outer periphery of the body; and a positioning means formed on the body to position the body in the compartment, wherein the positioning means includes a plurality of positioning members extended outward and upward from the outer periphery of the body, each said positioning member abutting against the polygonal inner periphery of the ratcheting tool when the nut holding device is received in the compartment of the ratcheting tool;

wherein each said elastic plate includes a distal upper end that extends outward for guiding the nut into a holding space defined by the elastic plates.

2. A nut holding device adapted to be mounted in a ratcheting tool of the type including a compartment defined by a polygonal inner periphery, the nut holding device comprising, in combination:

a body adapted to be mounted in the compartment wherein the body includes an outer periphery and an upper side;

a holding means formed on the upper side of the body for holding a nut to be loosened, wherein the holding means includes a plurality of annularly spaced elastic plates extended upward and inward from the outer periphery of the body; and a positioning means formed on the body to position the body in the compartment, wherein the positioning means includes a plurality of positioning members extended outward and upward from the outer periphery of the body, each said positioning member abutting against the polygonal inner periphery of the ratcheting tool when the nut holding device is received in the compartment of the ratcheting tool;

wherein the number of the elastic plates is at least three.

3. A nut holding device adapted to be mounted in a ratcheting tool of the type including a compartment defined by a polygonal inner periphery, the nut holding device comprising, in combination:

a body adapted to be mounted in the compartment, wherein the body includes an upper side; and a holding means formed on the upper side of the body for holding a nut to be loosened; and wherein the body further comprises a supporting means formed on an underside thereof for supporting the body in the compartment of the ratcheting tool in an elevated manner.

4. The nut holding device as claimed in claim 3, wherein the supporting means includes a plurality of posts provided along a periphery of the underside of the body.

5. The nut holding device as claimed in claim 4, wherein the nut held in the holding means is adjacent to an open top face of the compartment of the ratcheting tool.

6. A nut holding device adapted to be mounted in a ratcheting tool of the type including a compartment defined by a polygonal inner periphery, the nut holding device comprising, in combination:

a body adapted to be mounted in the compartment, the body including an outer periphery;

a plurality of annularly spaced elastic plates extended inwardly and upwardly from the outer periphery of the body for holding a nut to be loosened; and a plurality of guide members each located between two adjacent said elastic plates and extended outwardly and upwardly from the outer periphery of the body to a level above the elastic plates for guiding the nut to be loosened into a holding space defined by the elastic plates; wherein the body further comprises a supporting means formed on an underside thereof for supporting the body in the compartment of the ratcheting tool in an elevated manner.

7. The nut holding device as claimed in claim 6, further comprising a positioning means formed on the body to position the body in the compartment.

8. The nut holding device as claimed in claim 7, wherein the positioning means includes a plurality of positioning members extended outward and upward from the outer periphery of the body, each said positioning member abutting against the polygonal inner periphery of the ratcheting tool when the nut holding device is received in the compartment of the ratcheting tool.

9. The nut holding device as claimed in claim 6, wherein the supporting means includes a plurality of posts provided along a periphery of the underside of the body.

10. The nut holding device as claimed in claim 6, wherein the nut held between the elastic plates is adjacent to an open top face of the compartment of the ratcheting tool.

11. The nut holding device as claimed in claim 6, wherein the number of the elastic plates is at least three.

12. A nut holding device adapted to be mounted in a ratcheting tool of the type including a compartment defined by a polygonal inner periphery, the nut holding device comprising:

a body adapted to be mounted in the compartment, the body including an outer periphery and an underside;

a plurality of annularly spaced elastic plates extended upward from the outer periphery of the body for holding a nut to be loosened; and a plurality of positioning members extended downward from the underside of the body, each said positioning member including a protruded section that is in frictional contact with the polygonal inner periphery of the ratcheting tool to prevent disengagement of the body from the ratcheting tool.

13. The nut holding device as claimed in claim 12, wherein the nut held between the elastic plates is adjacent to an open top face of the compartment of the ratcheting tool.

14. The nut holding device as claimed in claim 12, further comprising a plurality of guide members each located between two adjacent said elastic plates and extended upward from the outer periphery of the body to a level above the elastic plates for guiding the nut to be loosened into a holding space defined by the elastic plates.

15. The nut holding device as claimed in claim 12, wherein the number of the elastic plates is at least three.

16. The nut holding device as claimed in claim 3, further comprising, in combination:

a positioning means formed on the body to position the body in the compartment.

17. The nut holding device as claimed in claim 16, wherein the body further includes an outer periphery; and wherein the nut holding device further comprises, in combination:

a plurality of guide members each extended upward from the outer periphery of the body to a level above the holding means for guiding the nut to be loosened into a holding space defined by the holding means.

18. The nut holding device as claimed in claim 3, wherein the body further includes an outer periphery; and wherein the nut holding device further comprises, in combination:

a plurality of guide members each extended upward from the outer periphery of the body to a level above the holding means for guiding the nut to be loosened into a holding space defined by the holding means.

* * * * *